US009963283B2

(12) United States Patent
Page et al.

(10) Patent No.: US 9,963,283 B2
(45) Date of Patent: May 8, 2018

(54) CUSHIONING WRAP MATERIAL AND APPARATUS AND METHODS OF MAKING SAME

(71) Applicant: Ranpak Corp., Concord Township, OH (US)

(72) Inventors: Brandon Cadette Page, Durham, NC (US); Keith Alexander Furr, Raleigh, NC (US); Marcelo Miller Passos, Morrisville, NC (US); Robert D. Hillebrand, Charlotte, NC (US); Lev Semenovich Grupin, Charlotte, NC (US); Richard B. Weslock, Fort Mill, SC (US); Christopher L. Duncan, Gastonia, NC (US)

(73) Assignee: RANPAK CORP, Painesville, OH (US)

( * ) Notice: Subject to any disclaimer, the term of this patent is extended or adjusted under 35 U.S.C. 154(b) by 488 days.

(21) Appl. No.: 14/406,176

(22) PCT Filed: Jun. 4, 2013

(86) PCT No.: PCT/US2013/044056

§ 371 (c)(1),
(2) Date: Dec. 5, 2014

(87) PCT Pub. No.: WO2013/184649

PCT Pub. Date: Dec. 12, 2013

(65) Prior Publication Data

US 2015/0140265 A1 May 21, 2015

Related U.S. Application Data

(60) Provisional application No. 61/655,520, filed on Jun. 5, 2012.

(51) Int. Cl.
*B65B 65/00* (2006.01)
*B65D 65/22* (2006.01)
(Continued)

(52) U.S. Cl.
CPC ..... *B65D 65/22* (2013.01); *B31D 1/0075* (2013.01); *B31D 5/0065* (2013.01); *B65D 81/03* (2013.01);
(Continued)

(58) Field of Classification Search
CPC ..... B65D 65/22; Y10T 428/24306
See application file for complete search history.

(56) References Cited

U.S. PATENT DOCUMENTS 3,776,081 A * 12/1973 Becker ..... B65B 41/16 53/168
5,667,871 A 9/1997 Goodrich et al.
(Continued)

FOREIGN PATENT DOCUMENTS

EP 1215036 6/2002
WO WO 9601731 A1 * 1/1996 ..... B31D 1/0031

OTHER PUBLICATIONS

International Search Report of corresponding International Application No. PCT/US2013/044056, dated Sep. 17, 2013.

*Primary Examiner* — William P Watkins, III
(74) *Attorney, Agent, or Firm* — Renner, Otto, Boisselle & Sklar, LLP

(57) ABSTRACT

A cushioning wrap material includes an elongate layer of expanded sheet material comprising an array of openings, and an elongate layer of interleaf material secured to the layer of expanded sheet material in face-to-face relationship. The expanded sheet material is expanded in length and thickness, and the layer of interleaf material may have a width equal to or less than a width of the layer of expanded sheet material. Typically, the layer of interleaf material is secured to the layer of expanded sheet material such that respective longitudinal centerlines of each layer are substantially aligned. The layer of expanded sheet material and
(Continued)

layer of interleaf material secured thereto are then wound into a roll. Typically, each layer is at least thirty feet in length.

17 Claims, 8 Drawing Sheets

(51) Int. Cl.
*B65D 81/03* (2006.01)
*B31D 5/00* (2017.01)
*B31D 1/00* (2017.01)

(52) U.S. Cl.
CPC ..... *Y10T 428/24306* (2015.01); *Y10T 428/24314* (2015.01); *Y10T 428/24331* (2015.01)

(56) References Cited

U.S. PATENT DOCUMENTS 5,688,578 A 11/1997 Goodrich
6,037,036 A * 3/2000 Febel ..... B26D 7/27 206/521
6,207,249 B1 * 3/2001 Lencoski ..... B31D 5/0047 138/166
2003/0148018 A1 * 8/2003 Hoffmann ..... A61F 13/0276 427/8

* cited by examiner

CUSHIONING WRAP MATERIAL AND APPARATUS AND METHODS OF MAKING SAME

FIELD OF THE INVENTION

The present invention relates generally to packing materials and, more particularly, to packing materials for wrapping articles.

BACKGROUND

When shipping an article from one location to another, the article is typically placed in a container along with protective packaging material to fill the voids about the article and to cushion the article during the shipping process. A common protective packaging material is a cellular foam polystyrene (e.g., STYROFOAM®, The Dow Chemical Corporation, Midland, Mich.) product having a peanut shape, and commonly referred to as "packing peanuts." However, the performance and ecological disadvantages of plastic packing peanuts as a void fill material is well known. The plastic material is not easily biodegradable when in a landfill and, although the plastic material can be recycled through reuse, such recycling programs have met with limited success. Moreover, articles within a package and surrounded by plastic packing peanuts may migrate within the package during shipping. Thus, an article centered within a box when packaged, may move to a side wall of the shipping container when transported, which may lead to damage to the article during shipment.

While a variety of products have been designed to provide a void fill substitute for plastic packing peanuts, each of the products has drawbacks. For example, starch products have been used, but tend to be excessively dusty and frangible. Products made from corn husks and other vegetation, are prone to attracting vermin, rodents, and the like.

Bubble wrap is a plastic packaging product that consists of small spheres of air bubbles. Unfortunately, bubble wrap has many negative aspects. For example, the polymer film used in bubble wrap is considered ecologically toxic because it can take hundreds of years to disintegrate in landfills. In addition, because of the air bubbles, bubble wrap is bulky and can cause storage problems.

Slit sheet paper packing material is an alternative, ecologically-friendly packing material that increases in thickness when stretched. This stretching and increase in thickness of the slit sheet paper packing material is referred to as expansion. Slit sheet paper packing material typically includes a durable paper with consecutive rows of slits cut into the paper. The thickness of the slit sheet paper packing material can increase by an order of magnitude, or more, relative to its original thickness, when stretched. This increased thickness allows the expanded material to serve as a protective cushioning wrap material for articles. Slit sheet paper packing material, and the manufacturing thereof, are described in greater detail in U.S. Pat. Nos. 5,667,871 and 5,688,578, the disclosures of which are incorporated herein by reference in their entireties.

Typically, a cushion wrap material formed with expanded slit sheet packing material includes a lightweight tissue paper that acts as a separator sheet between layers of the expanded material. The tissue paper prevents openings in the expanded paper from becoming undesirably interlocked. As such, it is desirable to maintain longitudinal centerlines of the tissue paper and expanded material relatively aligned. Unfortunately, long lengths of expanded material and tissue paper may be somewhat unwieldy to manage, thereby making it difficult to maintain proper alignment therebetween.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, a cushioning wrap material that is an eco-friendly alternative to bubble, plastic, foam, and packing peanuts includes an elongate layer of expanded sheet material comprising an array of openings (e.g., an array of hexagonal openings, diamond-shaped openings, etc.), and an elongate layer of interleaf material secured to the layer of expanded sheet material in face-to-face relationship. The expanded sheet material is durable, slit sheet paper, such as Kraft paper, that has been stretched to provide increased thickness. Typically, the thickness increases from an initial thickness of about four thousandths of an inch (0.004") to about three eighths inch (0.375"). The layer of interleaf material is a lighter weight material, such as tissue paper. In some embodiments, the layer of interleaf material has a width less than a width of the layer of expanded sheet material such that opposite, longitudinally-extending side edge portions of the layer of expanded sheet material are exposed. The width of the interleaf material may be up to about 50% less than a width of the expanded sheet material. However, in some embodiments, the layer of interleaf material may have a width that is substantially the same as a width of the layer of expanded sheet material. As such, embodiments of the present invention may include a layer of interleaf material with a width equal to or about 50% less than a width of the expanded sheet material.

Typically, the layer of interleaf material is secured to the layer of expanded sheet material such that respective centerlines of each layer are substantially aligned. The layer of expanded sheet material and layer of interleaf material secured thereto are then wound into a roll. Typically, each layer is at least thirty feet (30 ft) in length, and may be one hundred fifty feet (150 ft) in length, or more. For example, in some embodiments, each layer may be three hundred feet (300 ft) in length and may be up to one thousand feet (1,000 ft) in length.

In some embodiments of the present invention, the layer of interleaf material is adhesively secured to the layer of expanded sheet material. For example, the layer of interleaf material may be secured to the layer of expanded sheet material via a plurality of spaced-apart, longitudinally-extending adhesive beads or lines, each adhesive bead or line located proximate to a respective longitudinally-extending side edge portion of the layer of interleaf material.

In other embodiments of the present invention, the layer of interleaf material is secured to the layer of expanded sheet material without the use of adhesive, for example, via a plurality of tabs extending from the layer of interleaf material that mechanically interlock with a respective plurality of openings in the array. The tabs may be located proximate the respective longitudinally-extending side edge portions of the layer of interleaf material.

Because the layer of expanded sheet material has an array of openings, the layer of interleaf material is visible therethrough. As such, in some embodiments of the present invention, the expanded sheet material and interleaf material may be provided with respective different colors for aesthetic effect.

According to other embodiments of the present invention, an apparatus for forming a cushioning wrap material includes a source of expandable material (e.g., slit sheet paper, etc.) in an unexpanded form, a source of interleaf material (e.g., light weight paper such as tissue paper, etc.), a winding station, a plurality of expander rolls located between the expandable material source and the winding station, and an adhesive station located downstream from the expander rolls. The expandable material extends from the expandable material source to the winding station and passes between the expander rolls such that the expandable material is stretched to an expanded form in length and thickness. Typically, the expandable material is stretched at least one and a half times (1.5×) from an initial unexpanded length of the expandable material. However, the expandable material may be stretched by amounts less than this, as well as amounts greater than this. For example, the expandable material may be stretched 1.1×, 1.2×, 1.3×, 1.4×, 1.6×, 1.7×, 1.8×, 1.9×, 2.0×, etc.

The thickness of the expandable material may increase by between about one hundred percent (100%) and about ten thousand percent (10,000%) when expanded. For example, the expandable material may have an original thickness of about four thousandths of an inch (0.004") and may be expanded to have a thickness of about three-eighths of an inch (0.375").

However, the expandable material may be increased in thickness by amounts less than this, as well as amounts greater than this. For example, in some embodiments, the expandable material may have an original thickness of about ten thousandths of an inch (0.010") and may be expanded to have a thickness of about one-eighth of an inch (0.125").

The adhesive station is configured to adhesively attach the interleaf material and the expandable material in its expanded form in face-to-face relationship to form the cushioning wrap material. The winding station is configured to wind the cushioning wrap material into a roll. To facilitate expansion of the expandable material, a winding speed of the winding station can be greater than a rotational speed of the expander rolls. Because of the changing diameter of the roll at the winding station the ratio of rotational speed is not always constant. However, the ratio of surface speed measured between the expansion rollers and the roll being wound should stay approximately constant.

In some embodiments of the present invention, the adhesive station includes at least one nozzle that is configured to apply a longitudinally-extending bead of adhesive to the interleaf material. For example, a pair of spaced-apart nozzles may be utilized, wherein each nozzle is configured to apply a longitudinally-extending bead of adhesive to the interleaf material proximate a respective longitudinally-extending side edge portion thereof.

In some embodiments of the present invention, at least first and second cooperating adjacent, spaced-apart guide bars are located downstream from and proximate to the expander rolls. The expandable material, in its expanded form after exiting the expander rolls, extends under the first guide bar and then over the second guide bar. The guide bars may have various shapes and configurations. For example, in some embodiments, one of the guide bars has a downwardly-extending arcuate configuration and the other guide bar has an upwardly-extending arcuate configuration. The guide bars are used to temporarily concentrate the force on the expandable material and aid in consistent opening and expansion of the expandable material.

Embodiments of the present invention may utilize various numbers of guide bars. For example, a single guide bar may be utilized. In other embodiments the expandable material can be expanded without the use of guide bars.

According to other embodiments of the present invention, a method of forming a cushioning wrap material includes expanding an elongate layer of expandable sheet material (e.g., slit sheet Kraft paper, etc.) in thickness and length to form a layer of expanded sheet material having an array of openings (e.g., an array of hexagonal openings, etc.), and securing an elongate layer of interleaf material (e.g., light weight paper such as tissue paper, etc.) to the layer of expanded sheet material in face-to-face relationship therewith. The layer of interleaf material is secured to the layer of expanded sheet material such that respective longitudinal centerlines of each layer are substantially aligned. Typically, the layer of interleaf material has a width less than a width of the layer of expanded sheet material such that opposite, longitudinally-extending side edge portions of the layer of expanded sheet material are exposed.

The elongate layer of interleaf material may be adhesively secured to the layer of expanded sheet material, for example, by applying at least one longitudinally-extending adhesive bead to the layer of interleaf material and pressing the layer of interleaf material and layer of expanded sheet material into face-to-face contact with the adhesive bead positioned therebetween. In some embodiments, a pair of spaced-apart, longitudinally-extending adhesive beads are applied to the layer of interleaf material. Each adhesive bead is located proximate to a respective longitudinally-extending side edge portion of the layer of interleaf material. The layer of interleaf material and layer of expanded sheet material are then pressed together into face-to-face contact with the adhesive beads positioned therebetween.

In other embodiments of the present invention, the elongate layer of interleaf material may be secured to the layer of expanded sheet material by interlocking a plurality of tabs extending from the layer of interleaf material with a respective plurality of openings in the array. The tabs are located proximate respective longitudinally-extending side edge portions of the layer of interleaf material. The tabs may be formed, for example, by perforating the interleaf material.

The layer of expanded sheet material and layer of interleaf material secured thereto are then wound into a roll. Typically, the layers are each at least one hundred feet (100 ft) in length.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 1:
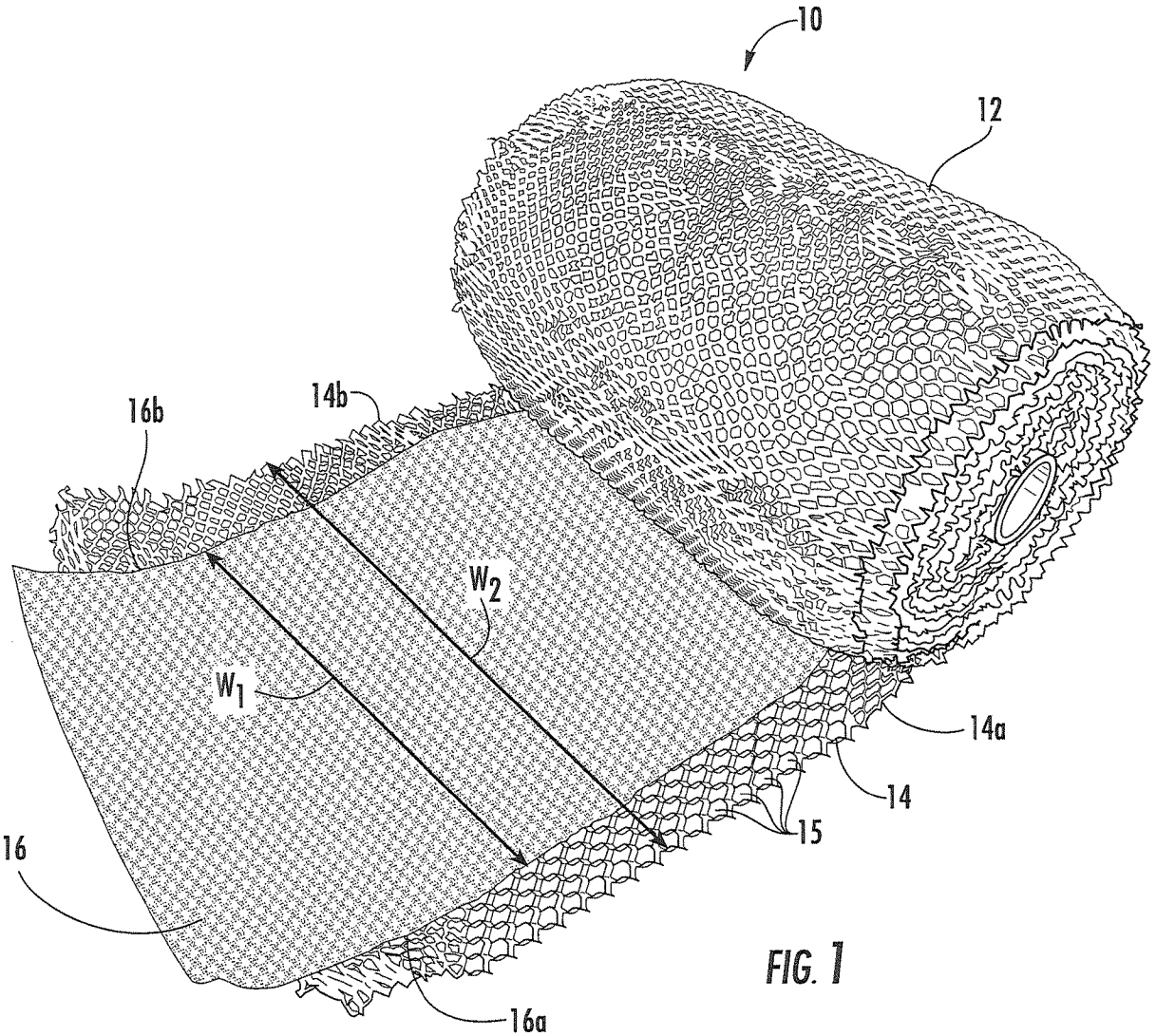
FIG. 1 is a perspective view of a roll of eco-friendly cushioning wrap material, according to some embodiments of the present invention, that includes an elongate layer of expanded material and an elongate layer of interleaf material secured thereto.

The present invention now is described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "about", as used herein with respect to a value or number, means that the value or number can vary by +/−twenty percent (20%).

The term "nozzle", as used herein, refers to any type of applicator that is configured to apply adhesive onto material, such as interleaf material and/or expandable material, including, but not limited to, projecting spouts, brushes, rolls, pads, etc.

The term "adhesive bead", as used herein, refers to any amount, shape, and/or configuration of adhesive as applied to material, such as interleaf material and/or expandable material. For example, an adhesive bead may be substantially flat or may be rounded. An adhesive bead may have a continuous configuration (e.g., continuous line or pattern, etc.) or non-continuous configuration (e.g., a series of spaced-apart portions, etc.).

The term "longitudinal centerline", as used herein, refers to the centerline of a layer of material that divides the lateral width (i.e., from side edge to side edge) of the layer in two equal halves.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Figure 3A:
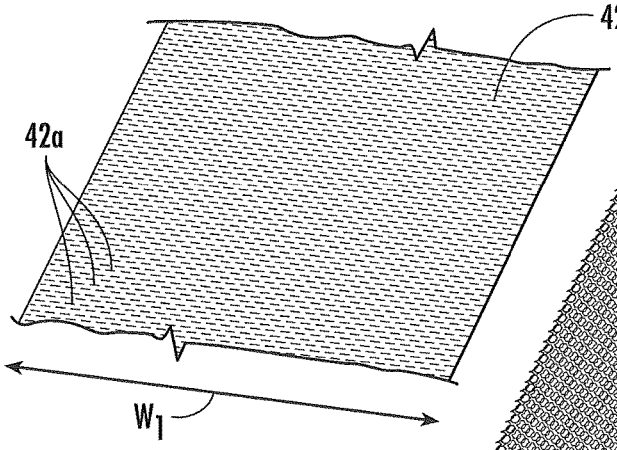
FIG. 3A is a partial perspective view of a layer of expandable material in an unexpanded form.
Figure 3B:
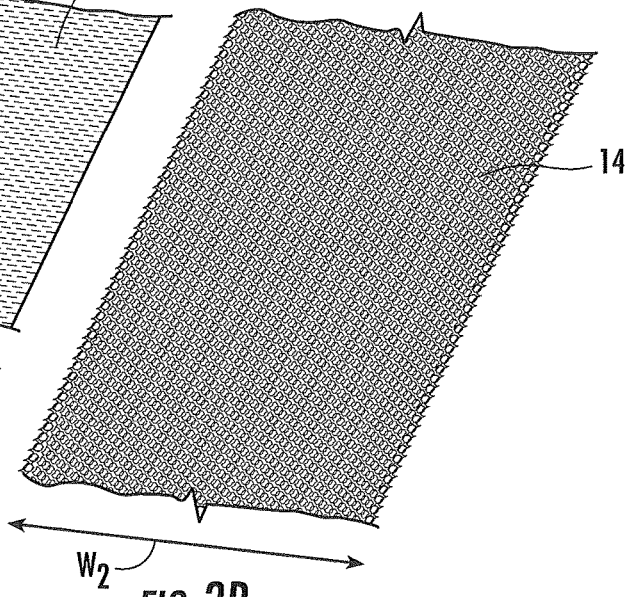
FIG. 3B is a partial perspective view of the expandable material of FIG. 3A in an expanded form.

Referring to FIG. 1, a roll 10 of eco-friendly cushioning wrap material 12, according to some embodiments of the present invention, is illustrated. The cushioning wrap material 12 can be an alternative to bubble packaging or other packaging used to protect items during shipping and moving. The illustrated cushioning wrap material 12 includes an elongate layer of expanded sheet material 14 comprising an array of openings 15, and an elongate layer of interleaf material 16 secured to the layer of expanded sheet material 14 in face-to-face relationship. Both the expanded sheet material 14 and interleaf material 16 can be biodegradable, recyclable and compostable. In some embodiments, the expanded sheet material 14 is slit sheet paper material, for example as described in U.S. Pat. Nos. 5,667,871 and 5,688,578, that is expanded in length and thickness from an initial unexpanded form to form the array of openings 15. FIG. 3A illustrates an exemplary layer of expandable material 42 in an unexpanded form, and having an array of slits/apertures 42*a* in an unexpanded form. FIG. 3B illustrates the expandable material 42 of FIG. 3A after stretching such that it is in an expanded form 14.

The thickness of the slit sheet material may increase by between about one hundred percent (100%) and about ten thousand percent (10,000%) when expanded. For example, the expandable material may have an original thickness of about four thousandths of an inch (0.004") and may be expanded to have a thickness of about three-eighths of an inch (0.375"). However, the expandable material may be increased in thickness by amounts less than this, as well as amounts greater than this. For example, in some embodiments, the expandable material may have an original thickness of about ten thousandths of an inch (0.010") and may be expanded to have a thickness of about one-eighth of an inch (0.125").

The length of the slit sheet material typically increases about one and a half time (1.5×) when stretched to an expanded form. However, the slit sheet material may be stretched by amounts less than this, as well as amounts greater than this. For example, the slit sheet material may be stretched 1.1×, 1.2×, 1.3×, 1.4×, 1.6×, 1.7×, 1.8×, 1.9×, 2.0×, etc.

The openings 15 may have various shapes, depending on the pattern of slits. For example, in some embodiments, the openings 15 have a hexagonal shape. In other embodiments, the openings 15 have a diamond shape. Embodiments of the present invention are not limited to any particular shape of the openings 15.

An exemplary slit sheet material that can be stretched to an expanded form is die-cut slit Kraft paper. An exemplary interleaf material 16 is a light weight paper, such as tissue paper. However, various types of paper and non-woven fibrous sheet materials may be utilized to form the expanded sheet material 14. Embodiments of the present invention are not limited to Kraft paper as the expanded sheet material 14. In addition, other types of materials may be utilized to form the interleaf material 16. Embodiments of the present invention are not limited to tissue paper as the interleaf material 16.

Because the layer of expanded sheet material 14 has an array of openings 15, the layer of interleaf material 16 is visible therethrough. As such, in some embodiments of the present invention, the expanded sheet material 14 and interleaf material 16 are provided with respective different colors for aesthetic effect. A variety of color combinations can be utilized.

In the illustrated embodiment, the layer of interleaf material 16 has a width W1 that is less than a width W2 of the layer of expanded sheet material such that opposite, longitudinally-extending side edge portions 14*a*, 14*b* of the layer of expanded sheet material 14 are exposed. In some embodiments, width W1 may be up to about 50% less than width W2. When an article is wrapped in the cushioning wrap material 12, openings in the exposed edge portions 14*a*, 14*b* of the expanded sheet material 14 can interlock with each other to help maintain the cushioning wrap material 12 in a wrapped state. However, in some embodiments, the layer of interleaf material 16 and the layer of expanded sheet material 14 may have widths that are substantially the same. As such, embodiments of the present invention may include a layer of interleaf material 16 with a width W1 equal to or about 50% less than a width W2 of the expanded sheet material 14.

Figure 2C:
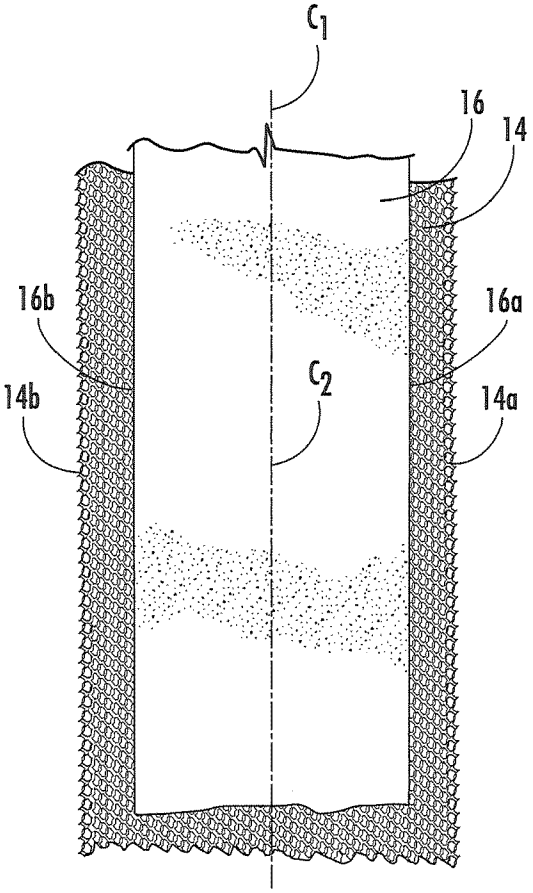
FIG. 2C is a partial plan view of the layer of expanded material in FIG. 2A and the layer of interleaf material in FIG. 2B secured together to form cushioning wrap material as illustrated in FIG. 1 and such that respective longitudinally-extending centerlines of each layer are substantially aligned.
Figure 2B:
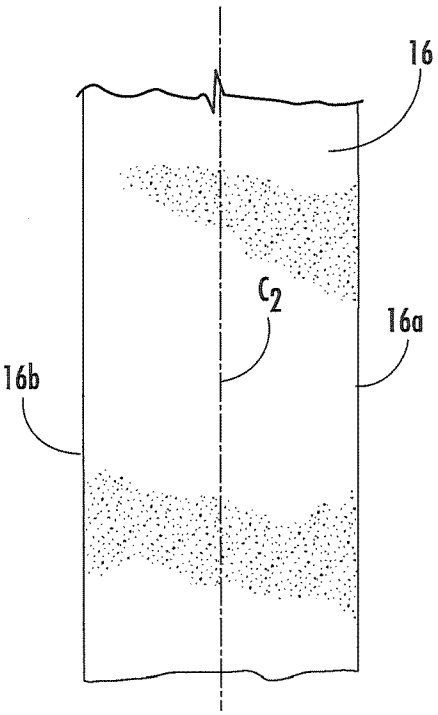
FIG. 2B is a partial plan view of a layer of interleaf material used to form the cushioning wrap material of FIG. 1 and illustrating a longitudinally-extending centerline thereof.
Figure 2A:
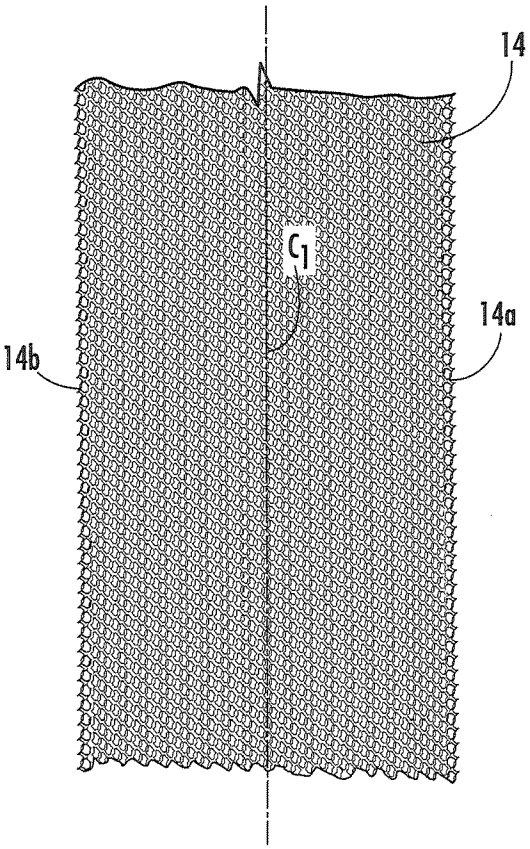
FIG. 2A is a partial plan view of a layer of expanded material used to form the cushioning wrap material of FIG. 1 and illustrating a longitudinally-extending centerline thereof.

Typically, the layer of interleaf material 16 is secured to the layer of expanded sheet material 14 such that respective longitudinal centerlines C1, C2 of each layer are substantially aligned, as illustrated in FIGS. 2A-2C. The layer of expanded sheet material 14 and the layer of interleaf material 16 secured thereto are then wound into a roll 10, as illustrated in FIG. 1. Typically, each layer 14,16 is at least thirty feet (30 ft) in length, and may be one hundred fifty feet (150 ft) in length, or more. For example, in some embodiments, each layer 14,16 may be three hundred feet (300 ft) in length and may be up to one thousand feet (1,000 ft) in length. Embodiments of the present invention are not limited to each layer 14, 16 having a particular length. The layers 14, 16 may have respective lengths between about thirty feet and about one thousand feet (30 ft-1,000 ft).

Figure 7:
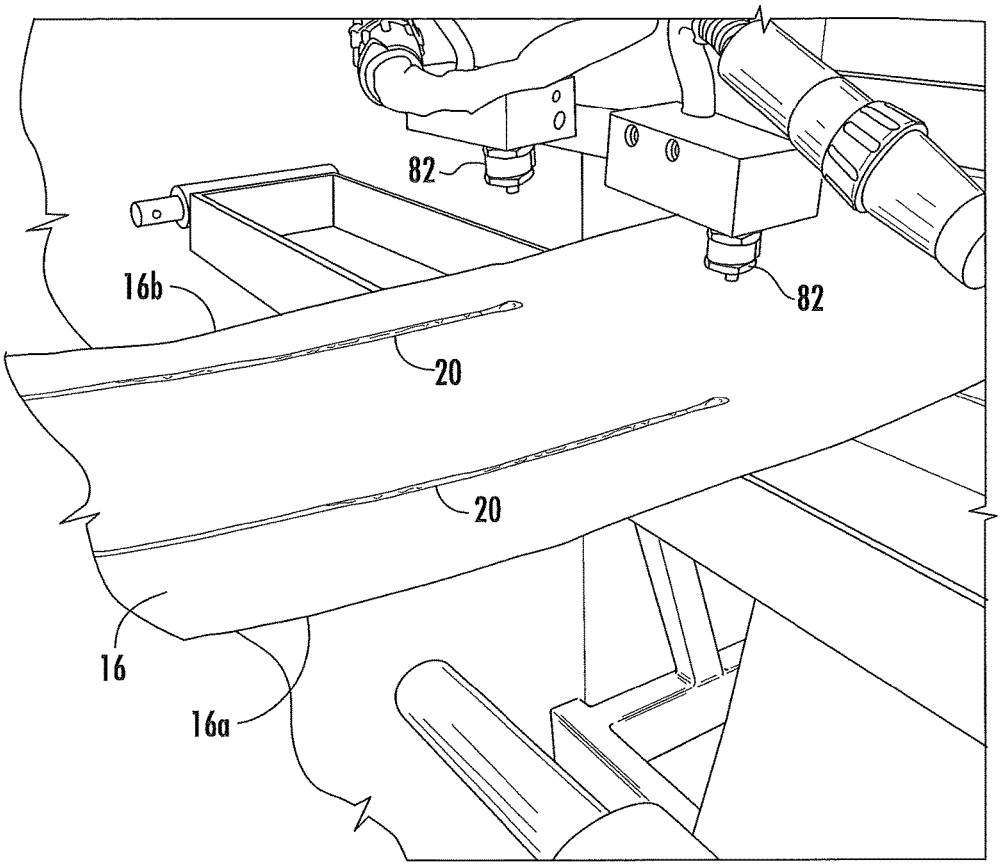
FIG. 7 is a partial perspective view of the apparatus of FIG. 5, illustrating nozzles for applying longitudinally-extending beads of adhesive to the layer of interleaf material prior to joining the interleaf material and expanded material in face-to-face contact.
Figure 8A:
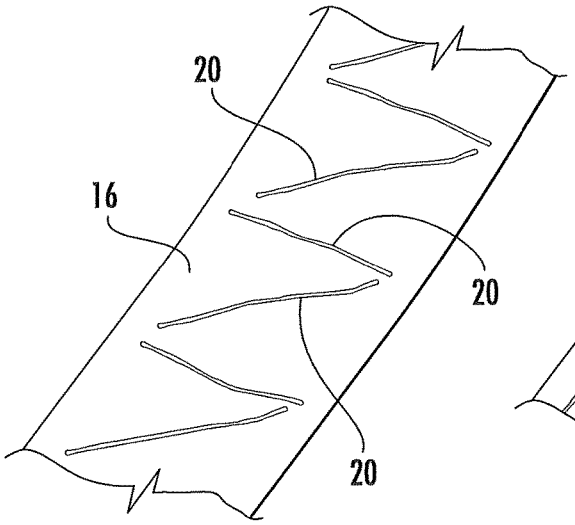
FIGS. 8A-8B are partial perspective views of a layer of interleaf material illustrating different patterns/configurations of adhesive applied thereto.
Figure 8B:
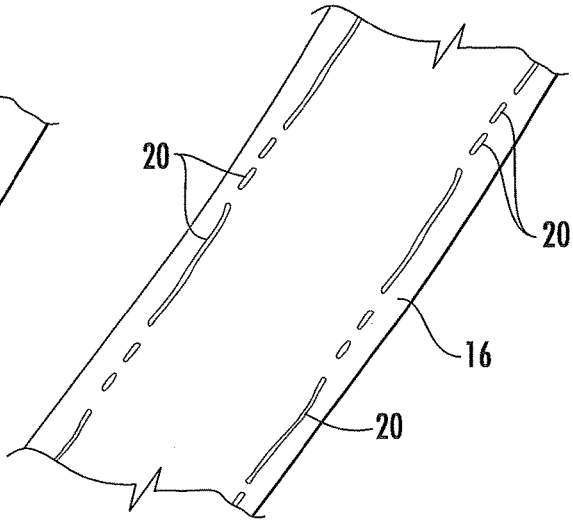

In some embodiments of the present invention, the layer of interleaf material 16 is adhesively secured to the layer of expanded sheet material 14. For example, the layer of interleaf material 16 may be secured to the layer of expanded sheet material 14 via a plurality of spaced-apart, longitudinally-extending adhesive beads 20, as illustrated in FIG. 7. In the illustrated embodiment of FIG. 7, each adhesive bead 20 is located proximate to a respective longitudinally-extending side edge portion 16*a*, 16*b* of the layer of interleaf material 16. However, as illustrated in FIGS. 8A-8S, adhesive 20 may be applied to the interleaf material 16 in other locations, in various patterns, etc. For example, the adhesive 20 can be applied as continuous beads, discontinuous beads, side-to-side beads, Z-shaped beads, dots, and the like.

Figure 9:
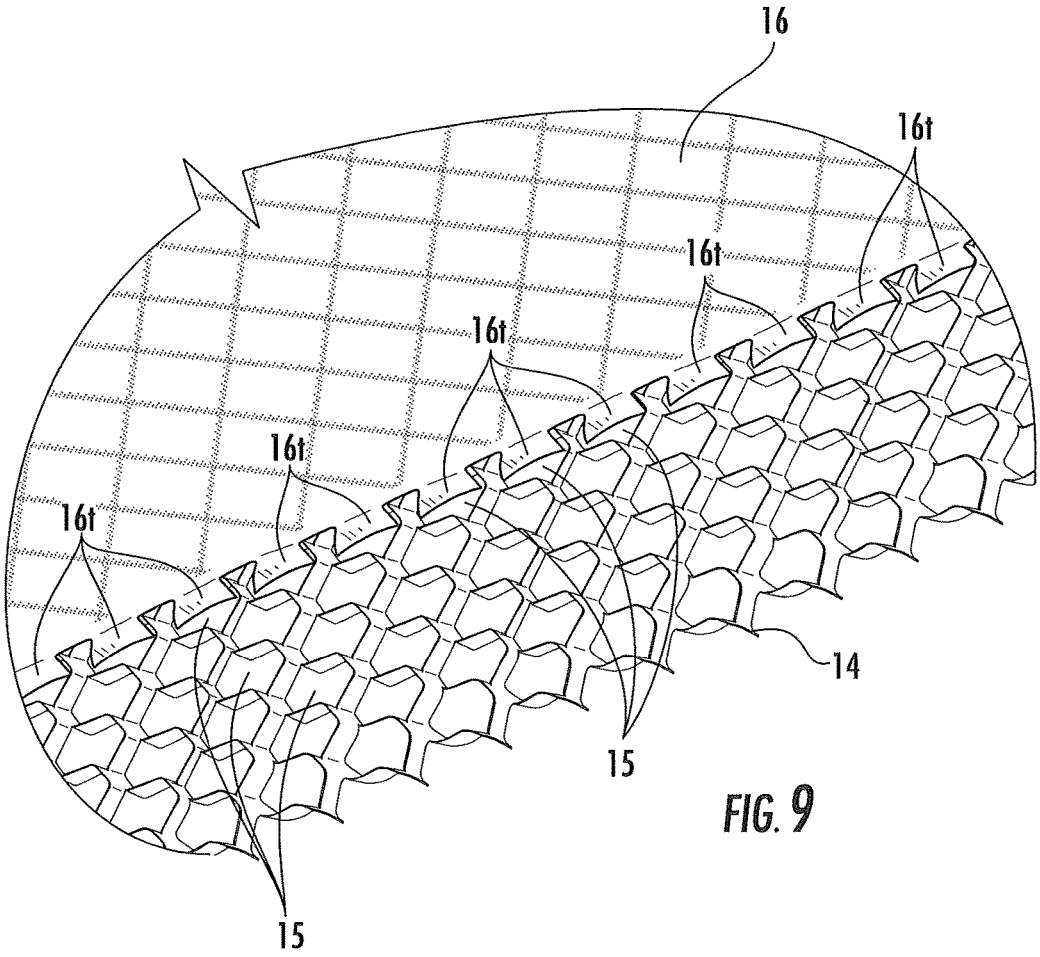
FIG. 9 is a partial perspective view of a cushioning wrap material, according to some embodiments of the present invention, showing the interleaf material and the expanded sheet material secured to each other without requiring adhesive.

In other embodiments of the present invention, the layer of interleaf material 16 may be secured to the expanded sheet material 14 without the use of adhesive. For example, as illustrated in FIG. 9, the layer of interleaf material 16 is secured to the layer of expanded sheet material 14 via a plurality of tabs 16*t* extending from the layer of interleaf material 16. These tabs 16*t* interlock with a respective plurality of openings 15 in the expanded sheet material 14 to secure the interleaf material 16 in face-to-face contact with the expanded sheet material 14. The tabs 16*t* may be located proximate the respective longitudinally-extending side edge portions 16*a*, 16*b* of the layer of interleaf material 16. For example, in FIG. 7, the tabs 16*t* are illustrated as being proximate longitudinally-extending side edge portion 16*a*. However, the tabs 16*t* may be located along any portion of the layer of interleaf material 16. Tabs 16*t* may be formed by perforating the interleaf material 16 or via other known methods. In some embodiments, the step of perforating the interleaf material 16 may also cause the tabs 16*t* created to be inserted within openings 15 in the expanded sheet material 14.

Figure 4:
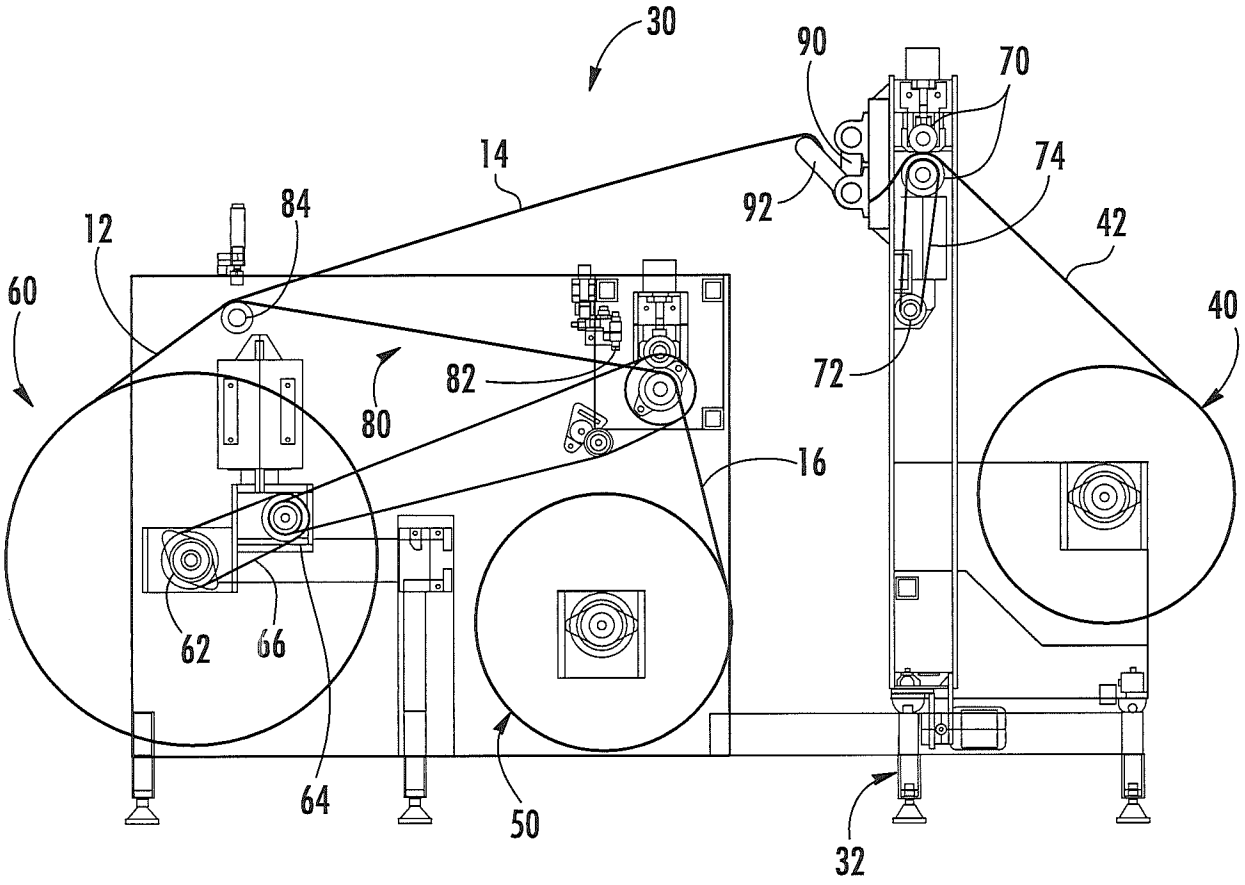
FIG. 4 is a cut-away schematic illustration of an apparatus for making the cushioning wrap material of FIG. 1, according to some embodiments of the present invention.
Figure 5:
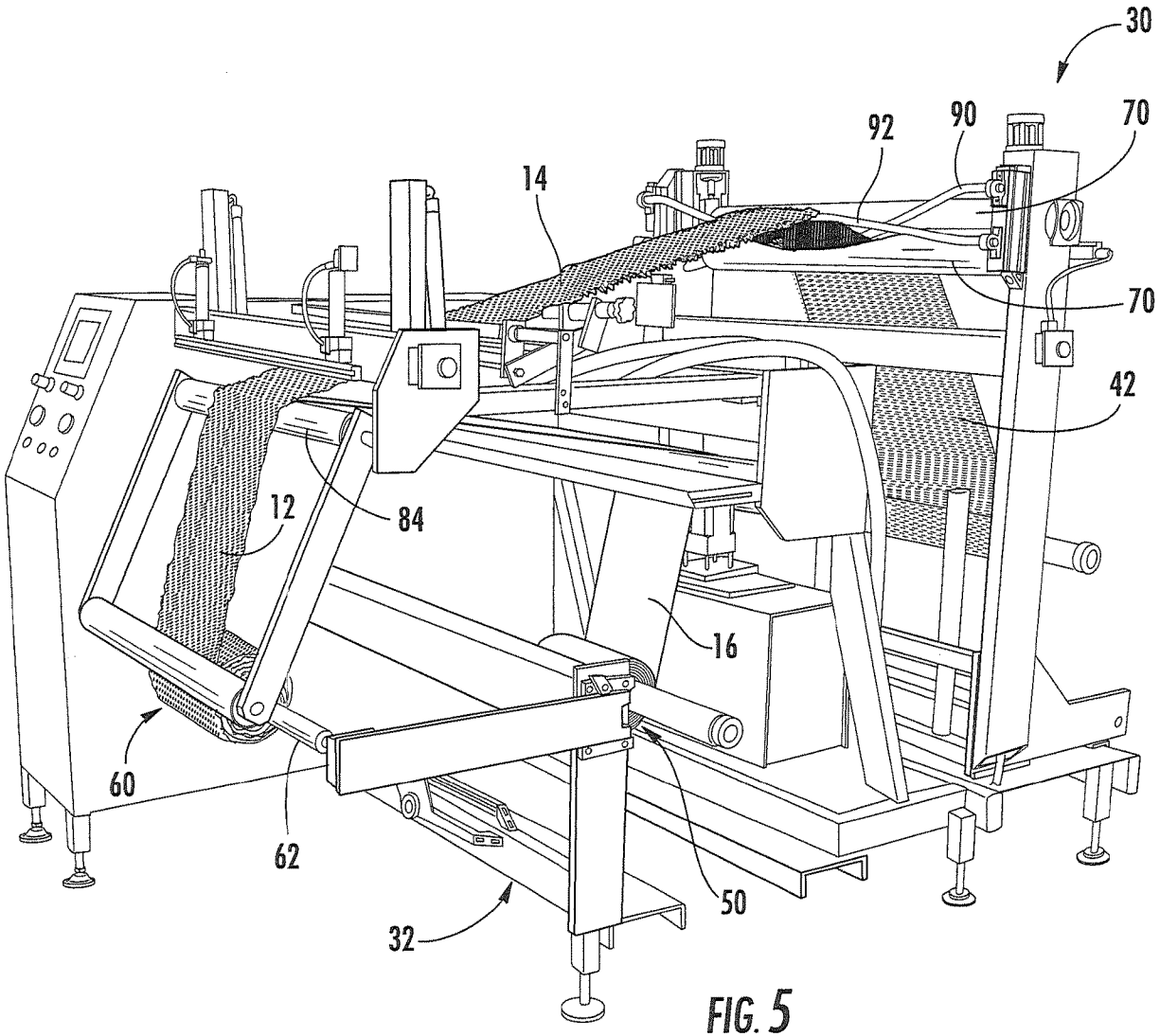
FIG. 5 is a side perspective view of the apparatus of FIG. 4, according to some embodiments of the present invention.
Figure 6:
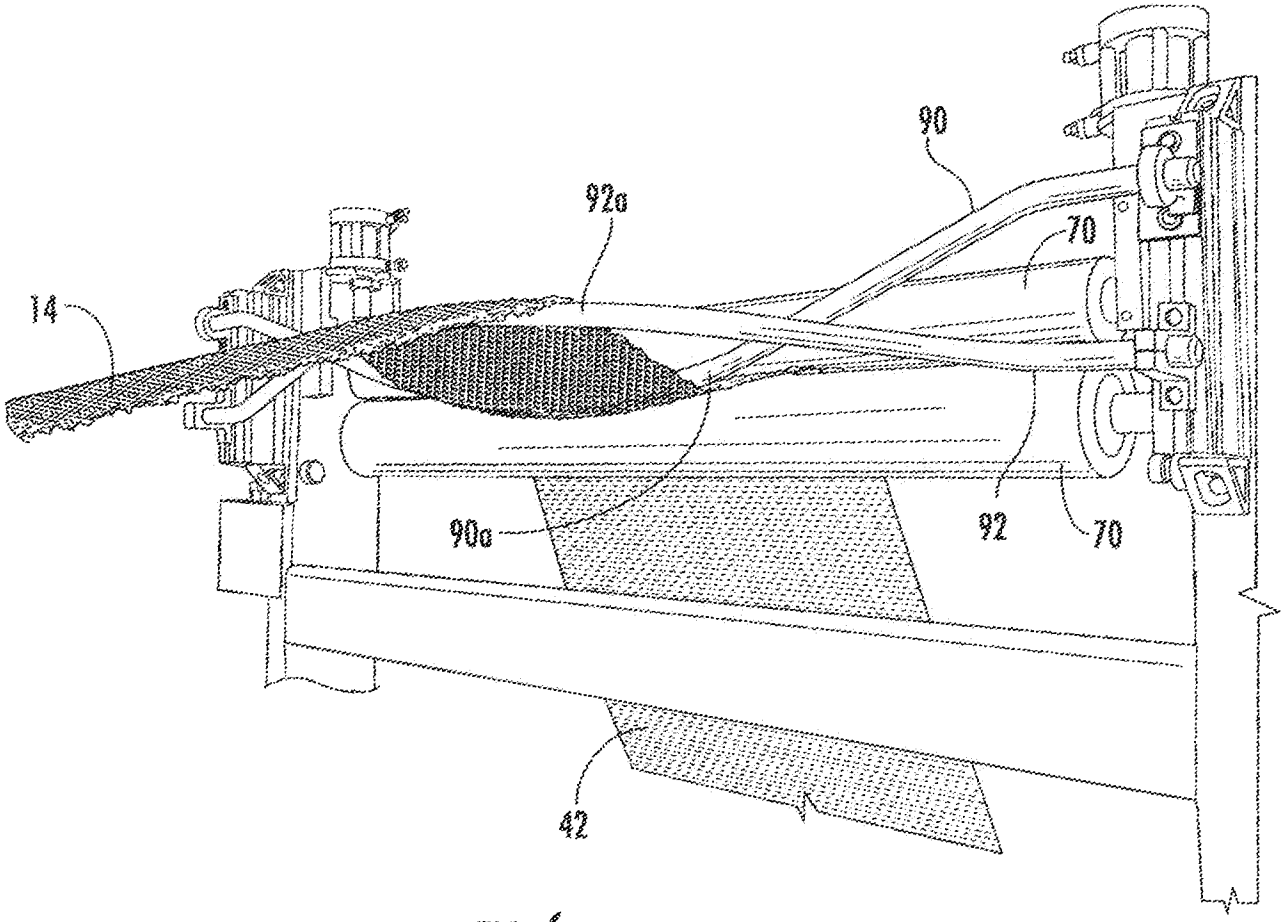
FIG. 6 is a partial perspective view of the apparatus of FIG. 5, illustrating the expander rolls and guide bars for stretching expandable material into an expanded form, according to some embodiments of the present invention.

Referring now to FIGS. 4-7, an apparatus 30 for forming a roll 10 of cushioning wrap material 12, according to embodiments of the present invention, is illustrated. FIG. 3 is a cut-away schematic view of the apparatus 30 and FIG. 4 is a side perspective view of the apparatus 30. The apparatus 30 includes a frame 32, a source 40 (e.g., a roll) of expandable material 42 in an unexpanded form, a source 50 (e.g., a roll) of interleaf material 16, and a winding station 60, each supported by the frame 32. The apparatus 30 also includes a pair of cooperating expander rolls 70 supported by the frame 32 and that are located between the expandable material source 40 and the winding station 60. An adhesive station 80 in this embodiment is supported by the frame 32 and is located downstream from the expander rolls 70. The frame 32 can be a single, unitary structure, or can be separate, floor-supported components, as would be understood by one skilled in the art.

The expandable material 42 extends from the expandable material source 40 to the winding station 60 and passes between the cooperating expander rolls 70 which cause the expandable material 42 to be stretched to an expanded form in length and thickness. The cooperating rolls 70 are tightly spaced relative to each other to contact the expandable material 42 such that the winding station 60 stretches the expandable material.

Typically, the expandable material 42 is stretched to an expanded form that is at least one and a half times (1.5×) an initial length of the expandable material 42 and to have a thickness that is between about one hundred percent (100%) and about ten thousand percent (10,000%) of an initial thickness. However, the expandable material 42 may be stretched by amounts less than this, as well as amounts greater than this. For example, the expandable material 42 may be stretched 1.1×, 1.2×, 1.3×, 1.4×, 1.6×, 1.7×, 1.8×, 1.9×, 2.0×, etc.

In some embodiments, the thickness of the expanded material 14 is between about one eighth of an inch (0.125") and about three-eighths of an inch (0.375"). For example, the expandable material 42 may have an original thickness of about four thousandths of an inch (0.004") and may be expanded to form the expanded material 14 that has a thickness up to about three-eighths of an inch (0.375"). The expanded material 14 can have various thicknesses and embodiments of the present invention are not limited to any particular thickness of the expanded material.

The winding station 60 includes a shaft 62 upon which the cushioning wrap material 12 is wound into a roll 10 after the interleaf material 16 and expanded sheet material 14 are joined together. In the illustrated embodiment, the shaft 62 is rotatably driven by a motor 64 via a belt 66, as would be understood by one skilled in the art. However, other drive systems can be used including rotary actuators, gearboxes, links/chains, and the like.

The expandable rolls 70 are driven by a motor 72 via a belt 74, as would be understood by one skilled in the art. However, other drive systems can be used including rotary actuators, gearboxes, links/chains, and the like.

The expandable material 42 is stretched to an expanded form by causing the winding speed of the winding station 60 to be greater than the rotational speed of the expander rolls 70. The slower rotational speed of the expander rolls 70 relative to the rotational speed at the surface of the roll of cushioning wrap material 12 being wound by shaft 62 at the winding station 60 causes the winding station 60 to stretch the expandable material 42 into the expanded sheet material 14 and without tearing the expandable sheet material 42. Because of the changing diameter of the roll of cushioning wrap material 12 being wound at the winding station 60, the ratio of rotational speeds of the roll surface and expander rolls 70 is not always constant. The ratio of surface speed measured between the expander rolls 70 and the roll of cushioning wrap material 12 being wound should stay approximately constant, however.

A typical speed of the cushioning wrap material 12 as it is wound via shaft 62 is about one hundred fifty feet per minute (150 fpm). However, other speeds may be utilized. In some embodiments, the average cycle time (i.e., the time to expand and wind a roll of cushioning wrap material 12) for a thirty foot (30 ft) roll of cushioning wrap material 12 is about ninety five seconds (95 sec.) at a speed of about 0.316 ft/sec. In some embodiments, the average cycle time for a one hundred fifty foot (150 ft) roll of cushioning wrap material 12 is about one hundred sixty seconds (160 sec.) at a speed of about 0.935 ft/sec. In some embodiments, the average cycle time for a five hundred foot (500 ft) roll of cushioning wrap material 12 is about three hundred seconds (300 sec.) at a speed of about 1.667 ft/sec.

Typically, the average speeds listed above would be the equal to the average surface speed measured on a roll of cushioning wrap material 12 being wound on shaft 62. In some embodiments, the surface speed at the expander rolls 70 would be at least 1.4× times less than the average surface speed measured on a roll of cushioning wrap material 12 being wound on shaft 62 at any given moment. However, embodiments of the present invention are not limited to any particular operational speeds or to any particular ratio of the surface speed at the expander rolls 70 and the average surface speed measured on a roll of cushioning wrap material 12 being wound on shaft 62.

The adhesive station 80 includes at least one nozzle 82 (shown as two nozzles in FIG. 7) configured to apply adhesive 20 (FIG. 7) to the interleaf material 16. The illustrated nozzles 82 in FIG. 7 are configured to apply respective longitudinally-extending beads of adhesive 20 to the interleaf material 16, each proximate a respective longitudinally-extending side edge portion 16*a*, 16*b* thereof. Adhesive may be applied to the interleaf material 16 in various ways, and embodiments of the present invention are not limited to the two illustrated nozzles 82. Moreover, as illustrated in FIGS. 8A-8S, adhesive 20 may be applied to the interleaf material 16 (or, alternatively to the expanded material 14) in other locations, in various patterns, etc. For example, the adhesive 20 can be applied as continuous beads, discontinuous beads, side-to-side beads, Z-shaped beads, dots, and the like.

In the illustrated embodiment, a routing guide or roll 84 (FIGS. 4, 5) is positioned downstream from the nozzles 82. The interleaf material 16 and the expanded sheet material 14 are joined together and pressed into face-to-face contact with the adhesive 20 positioned therebetween as they pass over the roll 84.

In the illustrated embodiment, a pair of adjacent, spaced-apart guide bars 90,92 are located downstream from and proximate to the expander rolls 70. The expanded sheet material 14 after exiting the expander rolls 70 extends under the first guide bar 90 and then over the second guide bar 92. In the illustrated embodiment, the first guide bar 90 has a downwardly-extending arcuate portion 90*a* and the second guide bar 92 has an upwardly-extending arcuate portion 92*a*. However, the guide bars 90,92 are not limited to the illustrated configurations, and may have various shapes and configurations. The guide bars 90, 92 are used to temporarily concentrate the force on the expandable material 42 and aid in consistent opening and expansion of the expandable material 42.

Embodiments of the present invention may utilize various numbers of guide bars, and are not limited to guide bars 90, 92. For example, a single guide bar may be utilized. In other embodiments the expandable material 42 can be expanded without the use of any guide bars.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. Cushioning wrap material, comprising:

an elongate layer of expanded sheet material including an array of openings, the expanded sheet material being expanded in length and thickness relative to an unexpanded form; and an elongate layer of interleaf material mechanically secured to the layer of expanded sheet material in face-to-face relationship, wherein the layer of interleaf material is mechanically secured to the layer of expanded sheet material via a plurality of tabs extending from the layer of interleaf material that interlock with a respective plurality of openings in the array, and wherein the tabs each have a free end extending outwardly from a respective longitudinally-extending side edge portion of the layer of interleaf material, the free ends interlocking into the array.

2. The cushioning wrap material of claim 1, wherein the layer of interleaf material is secured to the layer of expanded sheet material such that respective longitudinal centerlines of each layer are substantially aligned.

3. The cushioning wrap material of claim 1, wherein the layer of expanded sheet material is die-cut slit paper and the layer of interleaf material is tissue paper.

4. An apparatus for forming a cushioning wrap material, the apparatus comprising:

a source of expandable material in an unexpanded form;

a source of interleaf material;

a winding station in communication with the expandable material;

first and second expander rolls located between the expandable material source and the winding station, wherein, in operation, the expandable material extends from the expandable material source to the winding station and passes between the first and second expander rolls; and an adhesive station with at least one nozzle located downstream from the first and second expander rolls and configured to apply at least one longitudinally-extending bead of adhesive to the interleaf material or the expandable material in its expanded form;

first and second adjacent, spaced-apart guide bars located downstream from and proximate to the expander rolls, wherein the expandable material extends under the first guide bar and then over the second guide bar, and wherein the first guide bar has a downwardly-extending arcuate configuration extending along a center axis of the first guide bar and the second guide bar has an upwardly-extending arcuate configuration extending along a center axis of the second guide bar; and a routing guide downstream from the adhesive station that forces the expandable material in its expanded form and the interleaf material together in face-to-face relationship to form a cushioning wrap material;

wherein the winding station is configured to wind the cushioning wrap material into a roll.

5. The apparatus of claim 4, wherein the expandable material passes between the expander rolls such that the expandable material is stretched to an expanded form in length and thickness.

6. The apparatus of claim 4, wherein a winding speed of the winding station is greater than a surface speed of the expander rolls.

7. The apparatus of claim 4, wherein the at least one nozzle includes a pair of spaced-apart nozzles, each nozzle configured to apply a longitudinally-extending bead of adhesive to the interleaf material proximate a respective longitudinally-extending side edge portion thereof.

8. The apparatus of claim 4, wherein the expandable material is stretched to an expanded form that is at least 1.4 times an initial length of the expandable material before the adhesive station.

9. A method of forming a cushioning wrap material, the method comprising:

expanding an elongate layer of expandable sheet material in thickness and length to form a layer of expanded sheet material having an array of openings; and mechanically securing an elongate layer of interleaf material to the layer of expanded sheet material in face-to-face relationship therewith, wherein securing the elongate layer of interleaf material to the layer of expanded sheet material includes interlocking a plurality of tabs extending from the layer of interleaf material with a respective plurality of openings in the array, and wherein the tabs each have a free end extending outwardly from a respective longitudinally-extending side edge portion of the layer of interleaf material, the free ends interlocking into the array.

10. The method of claim 9, wherein the layer of interleaf material is secured to the layer of expanded sheet material such that respective longitudinal centerlines of each layer are substantially aligned.

11. The method of claim 9, wherein the tabs are proximate respective longitudinally-extending side edge portions of the layer of interleaf material.

12. The method of claim 9, wherein the layer of expanded sheet material is die-cut slit paper, and the layer of interleaf material is tissue paper.

13. The cushioning wrap material of claim 1, wherein the layer of interleaf material has a width less than a width of the layer of expanded sheet material such that opposite, longitudinally-extending side edge portions of the layer of expanded sheet material are exposed.

14. The cushioning wrap material of claim 1, wherein the layer of expanded sheet material and layer of interleaf material secured thereto are in a roll, and wherein the layer of expanded sheet material and layer of interleaf material in the roll are each at least about thirty feet (30 ft) in length.

15. The method of claim 9, further including the step of winding the layer of expanded sheet material and layer of interleaf material secured thereto into a roll.

16. The method of claim 9, wherein the layer of interleaf material has a width less than a width of the layer of expanded sheet material such that opposite, longitudinally-extending side edge portions of the layer of expanded sheet material are exposed.

17. The cushioning wrap material of claim 1, wherein each of the tabs of the interleaf material extends from a base end at the respective longitudinally-extending side edge portion to the respective free end disposed opposite the base end, and wherein the free end has a length extending along the longitudinally-extending side edge portion that is greater than a length of the base end extending along the longitudinally-extending side edge portion.

* * * * *